US011427781B2

(12) United States Patent
Dasari et al.

(10) Patent No.: US 11,427,781 B2
(45) Date of Patent: Aug. 30, 2022

(54) PRODUCTS PRODUCED FROM DISTILLERS CORN OIL

(71) Applicant: ICM, Inc., Colwich, KS (US)

(72) Inventors: Mohan Prasad Dasari, West Des Moines, IA (US); Kidron Joel Knox, Ankeny, IA (US); Charles C Gallop, Gower, MO (US); Kurt A Dieker, Wichita, KS (US); Hugh Tallant Warren, Des Moines, IA (US); Shashank Ravi, Des Moines, IA (US)

(73) Assignee: Corn Oil One, LLC, Pleasant Hill, IA (US)

( * ) Notice: Subject to any disclaimer, the term of this patent is extended or adjusted under 35 U.S.C. 154(b) by 0 days.

(21) Appl. No.: 15/371,435

(22) Filed: Dec. 7, 2016

(65) Prior Publication Data

US 2017/0107452 A1 Apr. 20, 2017

Related U.S. Application Data

(63) Continuation-in-part of application No. 15/167,494, filed on May 27, 2016, which is a continuation-in-part of application No. 14/079,059, filed on Nov. 13, 2013, now Pat. No. 9,353,331.

(60) Provisional application No. 61/793,727, filed on Mar. 15, 2013, provisional application No. 61/725,598, filed on Nov. 13, 2012.

(51) Int. Cl.

| | |
|---|---|
| ***C11B 3/00*** | (2006.01) |
| ***C11B 3/06*** | (2006.01) |
| ***C11B 3/16*** | (2006.01) |
| ***C11B 3/02*** | (2006.01) |
| ***C11B 7/00*** | (2006.01) |
| ***C11B 3/12*** | (2006.01) |

(52) U.S. Cl.

CPC ..... *C11B 3/001* (2013.01); *C11B 3/00* (2013.01); *C11B 3/006* (2013.01); *C11B 3/008* (2013.01); *C11B 3/02* (2013.01); *C11B 3/06* (2013.01); *C11B 3/12* (2013.01); *C11B 3/16* (2013.01); *C11B 7/0008* (2013.01); *C11B 7/0066* (2013.01)

(58) Field of Classification Search

CPC ..... C11B 3/02
USPC ..... 554/212
See application file for complete search history.

(56) References Cited

PUBLICATIONS

SA-Line, Product Description of Refined Corn Oil , 2018.*
Neshiel Chemical Pvt. Ltd., Product Description of Refined Corn Oil , 2018.*

* cited by examiner

*Primary Examiner* — Deborah D Carr
(74) *Attorney, Agent, or Firm* — Brick Gentry PC; Brian J. Laurenzo; Jessica L. Susie

(57) ABSTRACT

Products produced from distillers corn oil include once refined corn oil product, food grade corn oil product, and free fatty acid product which may be used in a variety of applications. The products have varying specifications for free fatty acid content and moisture content. The applications include food, feed, additives, and manufacture of industrial products.

15 Claims, 4 Drawing Sheets

PRODUCTS PRODUCED FROM DISTILLERS CORN OIL

CROSS-REFERENCE TO RELATED APPLICATIONS

This application is a continuation-in-part of U.S. non-provisional patent application Ser. No. 15/167,494 filed on May 27, 2016 and entitled "Method to Recover Free Fatty Acids from Fats and Oils," which is a continuation-in-part of U.S. non-provisional patent application Ser. No. 14/079,059, filed on Nov. 13, 2013 and entitled "Method to Recover Free Fatty Acids from Fats and Oils, which claims priority from U.S. Provisional Application Ser. No. 61/725,598 filed Nov. 13, 2012 and entitled "METHOD TO RECOVER FREE FATTY ACIDS FROM FATS AND OILS" and from U.S. Provisional Application Ser. No. 61/793,727 filed Mar. 15, 2013 and entitled "METHOD TO RECOVER FREE FATTY ACIDS FROM FATS AND OILS". The contents of U.S. patent application Ser. No. 15/167,494, U.S. patent application Ser. No. 14/079,059, U.S. Provisional Application Ser. No. 61/725,598, and U.S. Provisional Application Ser. No. 61/793,727 are hereby incorporated in their entireties by reference.

TECHNICAL FIELD

The subject matter of this disclosure relates generally to products created from the removal and recovery of free fatty acids and other impurities from fats and oils. Specifically, high value oil products and free fatty acid product produced from processes for treating distillers corn oil.

BACKGROUND

Some fats and oils contain high free fatty acid content, including but not limited to corn oil and waste fats and oils. As is generally known in the art, fats and oils containing a high percentage of free fatty acids are undesirable. For example, free fatty acids decrease the oxidative stability of oil. Previous methods include the refining of crude oils, which generally result in oil of low free fatty acid content. The crude oils, which have low free fatty acid content, are purified by converting the fatty acids to soaps using caustic or alkali and then separating the free fatty acid soaps, commonly referred to as soapstock, from the oil. The soapstock is then treated as a waste product or used for animal feed and soap manufacturing. These methods fail to capitalize on the potential of free fatty acids as a valuable product within the fats and oils industry. Moreover, previous methods lead to the formation of an emulsion that entraps neutral oil, thus resulting, in a high neutral oil loss. The neutral oil loss is exacerbated in the case of waste fats and oils due to the presence of high free fatty acid content. This is problematic because neutral oil is a valuable product. Accordingly, an ideal method will minimize neutral oil loss.

As provided above, fats and oils with high free fatty acids may include corn oil and waste fats and oils. For example, corn oil, including but not limited to corn oil that is produced as a byproduct of an ethanol production plant, may include at least 4% free fatty acids by weight. Other fats and oils with high free fatty acid content include high acid grease from pork plants, high acid tallow from beef plants, waste fryer grease, and sorghum wheat oil, such as from an ethanol plant utilizing sorghum. Moreover, a byproduct of biodiesel production may include unreacted fats and oils with high free fatty acid content. Generally, all of these fats and oils are inedible, industrial and fall into secondary or tertiary grade fats and oils. They may have a free fatty acid content of up to 90%. Processing these fats and oils to recover the free fatty acids results in at least two valuable products: neutral oil and free fatty acids. Additionally, other impurities that are removed in the method may be valuable products.

Previous attempts have been made to remove free fatty acids from oil, particularly crude oil having low free fatty acid content. These methods have drawbacks. In particular, these methods are unsuccessful when removing free fatty acids from starting material having high free fatty acid content. For example, the methods are ineffective when recovering free fatty acids from corn oil produced at an ethanol production facility and waste fats and oils. Oftentimes, these methods include adding alkali to the oil to create free fatty acid soaps. However, the addition of alkali to fats and oils having high free fatty acid content results in an emulsion. The emulsion includes fatty acid soaps and neutral oil and must be further processed to remove these valuable substances. Alter-natively, if the emulsion is not processed, the recovery of both fatty acids and neutral oil will be reduced, resulting in a loss of valuable products. Moreover, because previous attempts to remove free fatty acids from fats and oils are directed to refining crude oil, the methods fail to capture free fatty acids as a valuable product.

In one example, United Kingdom Patent Specification No. 427,680 discloses a process for refining vegetable and animal oils and fats. The subject matter described therein relates to the separation of fatty acid soaps formed by free fatty acids and caustic. The disclosed process addresses the problem of an emulsion by treatment with an alcoholic solution of salts sufficiently concentrated to prevent most oil from going into solution. Effective salts include alkali metal salts such as sodium sulfate, chloride, nitrate, formate, and acetate. The reference argues that the salts prevent neutral oil from dissolving in the alcoholic solution. A similar process is disclosed in United Kingdom Patent Specification No. 1,391,906, which discloses a process for the removal of fatty acids from glyceride oils. The process includes mixing the oil with an aqueous alkaline solution including polyhydric alcohol and sulfonate salt.

In another process, United Kingdom Patent Specification No. 430,381 is directed to the recovery of solvents employed during the refining of oils and fats. The reference discloses the process of neutralizing the oil to produce soap-stock and drying the fatty acid soaps in a vacuum prior to adding alcohol to the fatty acid soaps. The addition of the alcohol to the dried soapstock forms three layers: neutral oil, soap, and a layer of emulsion. The emulsion layer must then be processed to remove soaps. This process is inefficient in that it requires the steps of drying the fatty acid soaps and processing the emulsion.

Another reference, U.S. Pat. No. 6,399,802 provides a method for soapstock acidulation. The method includes adding both a monohydric alcohol to soapstock to lower its viscosity and a strong acid which hydrolyzes the fatty acid soaps. The acidulated fatty acids may then be converted to esters utilizing the alcohol already present in the solution, as well as catalysts already present in the solution. Effective alcohols include isopropanol, n-propanol, isoamyl alcohol, and fusel oil.

None of the above methods provides an efficient means for recovering the free fatty acids found in fats and oils having high free fatty acid content and/or providing valuable products from these methods. Moreover, none of the above methods may be easily integrated into an ethanol production facility or capitalize on the products and byproducts produced in the methods.

Crude vegetable oils that are food grade typically have free fatty acid content of about 1% in addition to other non-oil impurities. These vegetable oils when refined through traditional alkali refining will result in process loss or neutral oil loss due to physical and chemical binding of oil with the co-products that are generated in the process. Although the neutral oil loss varies with different processes, there are some generally accepted empirical equations that are used by the producers to help estimate the neutral oil loss. American Oil Chemists' Society (AOCS) official methods Ca 9f-57 and Ca-9a-52 form the basis for calculating the neutral oil loss due to processing and inevitable loss due to the presence of free fatty acids, phosphatides and other impurities. L. Strecker et al. developed an equation specific to the process loss during the alkali refining of crude corn oil. According to this given formula, neutral oil loss for alkali refining of crude corn oil with 12% free fatty acid content is about 11% in addition to the inevitable loss due to removal of free fatty acids, impurities etc. Corn oil having 4% free fatty acid content may have neutral oil loss around 4.5% in addition to the inevitable loss due to removal of free fatty acids, impurities etc. Previous methods provide the principle that as free fatty acid content increases, so does neutral oil loss, such as the example immediately above.

Accordingly, there exists a need in the art for producing refined oil products from refining process and producing free fatty acid product from recovering free fatty acids and other impurities from distillers corn oil.

SUMMARY

This disclosure describes once refined corn oil product produced from distillers corn oil, where the once refined corn oil product has a composition of a free fatty acid content of less than 1% by weight and a moisture content ranging from about 0.09% to about 0.35% by weight.

The disclosure also describes a food grade corn oil product produced from distillers corn oil, where the food grade corn oil product has a free fatty acid content of less than 0.05% by weight and a moisture content ranging from about 0.1 to about 0.5% by weight.

The disclosure also describes a free fatty acid product produced from distillers corn oil, where the free fatty acid product has a free fatty acid content greater than 50% by weight and a moisture content ranging from about 0.4% to about 1% by weight.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other aspects and advantages of the claimed subject matter will be apparent from the following Detailed Description of the embodiments and the accompanying figures.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. The features of one embodiment may be employed with other embodiments, as the skilled artisan would recognize, even if not explicitly stated herein.

DETAILED DESCRIPTION

Figure 1:
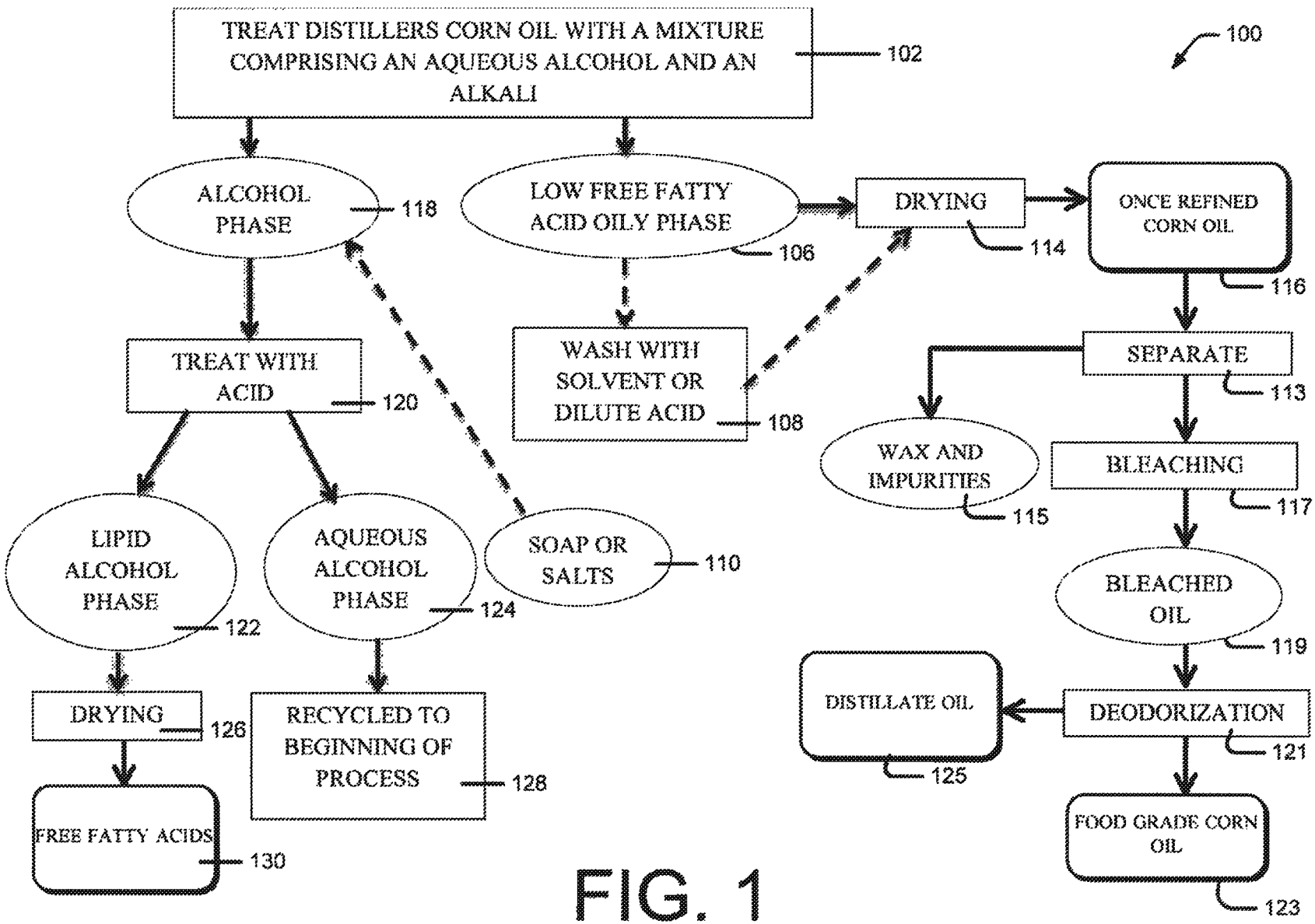
FIG. 1 is a flow chart according to one or more examples of a first embodiment of a method to recover free fatty acids from distillers corn oil, and to produce refined oil products and a free fatty acid product.

The Detailed Description explains embodiments of the subject matter and the various features and advantageous details more fully with reference to non-limiting embodiments and examples that are described and/or illustrated in the accompanying figures and detailed in the following attached description. Descriptions of well-known components and processing techniques may be omitted so as to not unnecessarily obscure the embodiments of the subject matter. The examples used herein are intended merely to facilitate an understanding of ways in which the subject matter may be practiced and to further enable those of skill in the art to practice the embodiments of the subject matter. Accordingly, the examples, the embodiments, and the figures herein should not be construed as limiting the scope of the subject matter.

This disclosure describes the different products that may be created from fats and oils as feedstock, which is the starting product. Fats and oils with high free fatty acids may include distillers corn oil (DCO), corn oil, waste fats, and other types of oils. The quality of these products are determined based on their specifications for triglyceride, diglyceride, free fatty content percent; moisture and volatile matter content percent; iodine value, oxidative stability index, peroxide value, and the like.

As an example only, the products may be produced from DCO, which is produced as a byproduct of an ethanol production plant. The DCO may include less than 15% of free fatty acid content by weight, about 3% moisture and impurity content with a reddish color. The products produced from the DCO, may include, but are not limited to, once refined corn oil product, food grade corn oil product, distillate oil product, and free fatty acid product. These products are used in a variety of applications in different industries.

A process produces the once refined corn oil product from DCO through a refining process. The refining process may include, but is not limited to, alkali refining, which may be used to lower free fatty acid content, moisture content, insoluble content and/or unsaponifiables content. An additional example of a refining process may include a physical refining through the use of increased temperature and decreased pressure for the removal of impurities. The physical refining process does come with additional neutral oil loss as discussed above. The once refined corn oil product of the present disclosure may have a composition of a free fatty acid content of about 1% by weight or less and a moisture content ranging from about 0.09% to about 0.35% by weight. There may be other components in the once refined corn oil product, such as beta-carotene content about 2 μg/g or less and tocopherol content of 1 mg/g or less. The once refined corn oil product may be used in animal feed, base oils, lubricants, human food, and various chemical applications. Also, the once refined corn oil product may be used in supplements and used to manufacture industrial products.

The process may take the once refined corn oil product for further refining processing to produce a food grade corn oil product. The refining processes may include, but are not limited to, alkali refining and physical refining (i.e., bleaching and deodorization). Physical refining processes are often used to further lower free fatty acid content, moisture content, insoluble content and/or unsaponifiables content. The food grade corn oil product of the present disclosure may have a composition of a free fatty acid content of less than 0.05% by weight and a moisture content ranging from about 0.1% to about 0.5% by weight. The food grade corn oil product is used in many applications, by satisfying Generally Regarded As Safe (GRAS) crude oil standards for cooking and as lubricants in food processing facilities, carriers for drug molecules in pharmaceutical preparations, and in nutraceutical applications. The nutraceutical applications include, being used in health foods, dietary supplements, food supplements, and food fortification products.

The distillate oil product is produced when the food grade corn oil product is produced, going through the same refining processes. This distillate oil product primarily contains ethyl esters, free fatty acids, triglycerides, sterols, and tocopherols. The distillate oil product may be used food additive, such as vitamins. The specification for triglycerides is less than 35 while the specification for tocopherol is less than 1 mg/g for food applications.

The free fatty acid product has been produced through the refining process along with other processes. These other processes include treating with acid and drying. The free fatty acid product may contain water and less than 22% ash on a water free basis. The free fatty acid product may or may not be acidulated before using in commercial feeds, but if acidulated, it should be neutralized. The free fatty acid product has a free fatty acid content ranging from about 3% to about 5% by weight, and a moisture content ranging from about 0.4% to about 1% by weight. In an embodiment, the specifications for the free fatty acid product may have a free fatty acid content of 3% by weight and a moisture content of 0.5% by weight. The free fatty acid product may be used in feed fat supplements, used to manufacture industrial products and used for the sales of fatty acids, glycerides, and phosphates. The free fatty acid product could be used in the feed products, where analysis of crude fat would be determined based on mixture of products.

FIG. 1 is a detailed description of embodiments of a method 100, for recovering free fatty acids from fats and oils. Fats and oils amenable to such a method may include, but are not limited to corn oil, such as distillers corn oil produced in an ethanol plant, sorghum wheat oil which may or may not be produced in an ethanol plant, high acid grease, high acid tallow, bleachable fancy tallow, fancy tallow, A tallow, prime tallow, special tallow, No. 2 tallow, yellow grease, flotation oils/greases from animal processing plant wastewater streams, fatty acid streams from biodiesel plants, acidulated soapstock oils and waste frying grease. Moreover, fats and oils that have become rancid and unsaleable at least in part because of the free fatty acid content may be processed by this method to create valuable, saleable products that may be used for food grade along with other uses. The disclosed methods have the advantage of being simple yet highly effective at recovering free fatty acids while minimizing neutral oil loss and emulsion formation. Furthermore, in some embodiments, the disclosed methods have the benefits of capitalizing on producing valuable products and byproducts of an ethanol production facility. Accordingly, one use of the disclosed method 100 is for the recovery of free fatty acids from corn oil and particularly distillers corn oil obtained as a byproduct of ethanol production. For ease of discussion and understanding, the following detailed description and illustrations often refer to the method for use with distillers corn oil. It should be appreciated that the method 100 of the present disclosure may be used with any fats and oils of animal or vegetable origin.

Turning to FIG. 1, a process 100 for recovering free fatty acids from fats and oils to produce the free fatty acid product and for refining process to produce the oil products is provided. As shown by block 102, the method begins by treating distillers corn oil with a mixture comprising an aqueous alcohol and an alkali. The alcohol, preferably aqueous alcohol, may also be referred to as the solvent. As mentioned above and discussed in further detail below, the alcohol is advantageous for effecting separation of an alcohol phase 118 and, in some embodiments, residual fatty acid soaps, from a low free fatty acid oily phase 106. The alkali is advantageous for converting free fatty acids to free fatty acid soaps. The process 100 results in a low free fatty acid oily phase 106 and an alcohol phase 118. Free fatty acids can also be extracted from distillers corn oil or crude fats and oils by using aqueous alcohols alone. This is based on the preferential solubility of free fatty acids in the alcohols over neutral oil. In order to sufficiently remove free fatty acids, this process requires a considerably large amount of an alcohol. Alcohols such as methanol, ethanol, propanol, isopropanol, butanol, isobutanol, pentanol, and combinations thereof may be used for this purpose. Laboratory tests show that the process requires about 4-5 times as much weight of alcohol to extract 15% free fatty acids from distillers corn oil than when alkali is also used. When alkali is used, the solvent to oil ratio may be about 0.4-0.6. Recovery of solvent back into the process, although energy intensive, can be easily done with a simple flash distillation due to high difference in the points of the solvent and oil. Moreover, the use of high amounts of solvent also increases the amount of neutral oil loss with the alcohol phase to about 5%, which is likely due to the solubility of oil in high volumes of alcohol. Although this is considerably less than the traditional refining methods, employing an alkali results in even further decreased neutral oil loss, as will be discussed herein below. Accordingly, as provided in FIG. 1, in the embodiment, a mixture comprising both an alcohol and an alkali is used. Suitable alkalis include, but are not limited to, hydroxides, oxides, carbonates, amines, and amides. For example, sodium hydroxide, potassium hydroxide, magnesium hydroxide, calcium hydroxide, lithium hydroxide, sodium amide, or ammonia may be used. Oftentimes, sodium hydroxide may be used in the process 100, due to its lower cost.

As discussed, above, acceptable alcohols include, but are not limited to, monohydric alcohols, such as methanol, ethanol, propanol, isopropanol, butanol, isobutanol, pentanol, and combinations thereof. Due to the difference in polarity of the aforementioned alcohols and neutral oil, the alcohols are less soluble with oil, leading to decreased neutral oil loss. In general, the alcohol reduces and/or eliminates the emulsion that can be formed when free fatty acids react with alkalis in only water as a solvent, thus effecting clean separation of the low-free fatty acid oily phase and alcohol phase. This provides the advantage of decreasing neutral oil loss while increasing the percentage of free fatty acids that are recovered in the process 100. In some embodiments, the process 100 of the present disclosure results in neutral oil loss of less than 10%, such as less than 7%, 3%, or, preferably, less than 2%. Ideally, neutral oil loss is as close to 0% as possible. However, some neutral oil loss is often inevitable. As discussed above, previous methods provide a greater neutral oil loss as free fatty acid content of the starting oil increases. As compared to previous methods, the process of the present disclosure provide a constant, low neutral oil loss for fats and oils with any amount of free fatty acids. Accordingly, while there may be some fluctuation in resulting neutral oil loss among types of oil, neutral oil loss remains generally constant for a particular type of oil. In addition, fluctuation in neutral oil loss for oils with varying contents of free fatty acids is minimized.

The alkali and free fatty acids react in a 1:1 mole ratio. Accordingly, for each mole of free fatty acids, one mole of alkali should be added. The free fatty acid content of the starting oil (DCO) may be obtained in the laboratory by methods known in the art, such as titration. In embodiments directed to corn oil obtained from an ethanol plant, it is anticipated that the free fatty acid content will generally be consistent in oils received from the same plant. The solvent to oil ratio is preferably about 0.6 by volume, although it is anticipated that other ratios will be effective. As discussed below in Example 7, lower ratios may result in higher neutral oil loss. On the other hand, employing as little solvent as possible is effective and provides for cost savings in the process. Moreover, if too little solvent is used, then an emulsion will occur, which results in neutral oil loss. Furthermore, this step may occur at temperatures of about 25-75 degrees Celsius and at about atmospheric pressure, such as with the reaction occurring at about 65 degrees Celsius at about atmospheric pressure. To some extent, the temperature range may be limited at the top by the boiling point of the alcohol, such as approximately 78 degrees Celsius at about atmospheric pressure for ethanol, while temperatures below about 25 degrees Celsius may lead to difficulty separating the low-free fatty acid oily phase and the alcohol phase in some circumstances.

In the exemplary embodiment disclosed herein, the process 100 is used for the treatment of distillers corn oil produced at an ethanol plant. Accordingly, ethanol or aqueous ethanol, is used as a solvent. Aqueous ethanol with an ethanol concentration of greater than about 15% by weight is preferred. For example, aqueous ethanols having about 15-55% ethanol by weight are used, such as aqueous ethanol with about 40% by weight ethanol, but it is anticipated that other concentrations will be effective. While an aqueous ethanol with about 40% ethanol is preferred, oftentimes the aqueous ethanol received from an ethanol plant will have a higher ethanol concentration, such as about 55%. This aqueous ethanol is effective in carrying out the claimed methods and can provide cost savings as there is no need to process the aqueous ethanol prior to using same as a solvent. However, it is contemplated that aqueous alcohols with a lower ethanol concentration may be more effective in preventing neutral oil loss. This is because neutral oil is more easily dissolved in aqueous ethanol with higher ethanol concentrations. Moreover, due to the polarity of oil and water, the presence of water reduces the solubility of oil in ethanol. Accordingly, aqueous alcohols with lower ethanol concentrations may result in decreased neutral oil loss. However, alcohol concentrations below 15% may not be effective in breaking the emulsion, and, as a result, neutral loss will increase.

Moreover, in some embodiments, a nonpolar solvent or partitioning agent may also be employed in this step of the process. If used, the nonpolar solvent is preferably added after the reaction takes place. The nonpolar partitioning solvent speeds the separation of the phases and may include, but is not limited to, pentane, hexane, petroleum ether, or combinations thereof. In such an embodiment it is anticipated that the two solvents will not mix. Accordingly, separation of the phases is enhanced and proceeds more quickly. It is anticipated that such an embodiment will be even more useful in certain animal fats and oils wherein the phases do not separate as easily as vegetable oils, for example corn oil.

As discussed above, the addition of the alcohol and alkali will result in two phases being formed: an alcohol phase 118 and a low free fatty acid oily phase 106. The low free fatty acid oily phase 106 will include neutral oil but may also include residual impurities, including residual free fatty acid soaps, the optional recovery of which will be discussed below. The alcohol phase 118 will include free fatty acid soaps, ethanol, water, and any impurities present in the oil, such as carotenoids, phytosterols, tocopherols, phytostanols, polyphenols, phospholipids, waxes, and/or other impurities, that have preferential solubility in the aqueous ethanol solvent phase.

The above treatment 102, which includes a reaction and an extraction, may be exploited in many different fashions, including but not limited to a batch system, a continuous stirred-tank reactor (CSTR), and continuous flow in a tubular or pipe system. For example, the treatment 1 02 may occur in a continuous tubular system, such as a carbon steel pipe containing at least one static mixer to effect mixing of the alkali and free fatty acids, as well as the free fatty acid soaps and aqueous ethanol. In one laboratory scale example, this treatment 102 of the process 100 may be carried out in an eleven-inch carbon steel pipe having a one half inch diameter. The pipe includes one static mixer with 12 elements for effective mixing of the substances. It is anticipated that this laboratory reactor is one-tenth the size of an industrial system that would be employed at a 50 million gallon per year ethanol plant. The described laboratory reactor will handle oil at 1200 ml/min, which will correspond to three gallons per minute rate of oil at the industrial scale.

In the preferred continuous tubular system, the low free fatty acid oily phase 106 and alcohol phase 118 flow into a decanter and are allowed to separate into two layers by settling for 15-30 minutes. Alternatively, the low free fatty acid oily phase 106 and alcohol phase 118 may be separated by any means known in the art, now or in the future, including but not limited to flowing the mixture of low free fatty acid oily 106 and alcohol 118 phases to a liquid-liquid centrifuge to be continuously separated into two phases or utilizing membrane separation, mechanical coalescence, electrocoalescence, or solvent partitioning to separate the mixture of low free fatty acid oily 106 and alcohol 118. The mixture may require either heating or cooling depending on the method of separation utilized. When using a decanter, as the layers settle, they are continuously drained or pumped from the decanter.

As discussed above and shown in FIG. 1, after drawing off the low free fatty acid oily phase 106, it may optionally be further processed. In one embodiment, the phase 106 may be washed with solvent or dilute acid, as shown in block 108. Suitable acids include both inorganic and organic acids, such as sulfuric acid, hydrochloric acid, phosphoric acid, citric acid, oxalic acid, and carbonic acid. In one embodiment, carbonic acid is obtained by treating the low-free fatty acid oily phase with carbon dioxide. Advantageously, carbon dioxide is a byproduct of ethanol production. The acid wash 108 results in salts and washed, low free fatty acid oil, which may be dried, as shown block 114. This produces the once refined corn oil product 116, which is one of the products available for sale.

In another embodiment, the low free fatty acid oily phase 106 may be dried without washing, as shown by block 114 to produce valuable the once refined corn oil product 116. In most embodiments, the low-free fatty acid oily phase 106 need not be processed to remove residual free fatty acid soaps, as the oil in the low-free fatty acid oily phase 106 meets many required specifications for sale as a valuable product. As discussed above, the once refined oil product 116 is a valuable product produced from this process 100.

The once refined corn oil product 116 has a composition of a free fatty acid content of less than 1% by weight and a moisture content ranging from about 0.09% to about 0.35% by weight. "Once refined corn oil product" refers to distillers corn oil, which has processed through a refining process, such as alkali refining. This is one of the products produced from this process 100.

The specifications for the once refined corn oil product are shown in Table 1.

TABLE 1

Specifications for Once Refined Corn Oil Product

| Analysis | Once Refined Corn Oil Product |
|---|---|
| FFA (%) | <1 |
| Color | >20R |
| Acid Value | <2 |
| IV | 120-130 |
| Phosphorous, PPM | <30 |
| Clarity | Clear |
| Moisture and Volatiles, % wt | <1 |
| Linolenic Acid, % wt | <1.5 |
| Unsaponifiable, % wt | <2 |
| PV, meq/kg | <2 |
| OSI, hr | >5 |
| TransFat, % wt | <1 |
| Triglycerides, % wt | >85 |
| Diglycerides, % wt | <6 |

The values in Table 1. represent conditions that are acceptable to the end user of the once refined corn oil product 116 for various applications. "Free fatty acid" refers to an unesterified fatty acid, or more specifically, a fatty acid having a carboxylic acid head and a saturated or unsaturated unbranched aliphatic tail (group) of from 4 to 28 carbons. Iodine Value (IV) refers to a mass of iodine in grams that is consumed by 100 grams of a chemical substance. IV numbers are often used to determine the amount of unsaturation in fatty acid. "Linolenic acid" is a type of fatty acid. It can refer to either of two octadecatrienoic acids (i.e. with an 18-carbon chain and three double bonds, which are found in the cis configuration), or a mixture of the two. "Unsaponifiables" refers to components of the product that do not form soaps, when blended with a base, and may include a variety of possible non-triglyceride materials. "Moisture and Volatiles" refer to the amount of moisture and volatiles in oils and fats, which is an important specification.

"Peroxide value" (PV) refers to the amount of peroxide oxygen (in millimoles) per 1 kilogram of fat or oil. PV is a test of the oxidation of the double bonds of the oils. PV is determined by measuring the amount of iodine ($I^-$) via colorimetry, which is formed by the reaction of peroxides (ROOH) formed in the oil with iodide via the following equation:

$$2I^- H_2O + ROOH \rightarrow ROH + 2OH^- + I_2$$

"Oxidative stability index" (OSI) value refers to the length of time the oil resists oxidation at a given temperature. The oxidation of oil is slow, until the natural resistance which may be due to the degree of saturation, natural or added antioxidants, is overcome. When overcome, oxidation accelerates and becomes very rapid. The measurement at this time is the OSI value.

Triglycerides are esters derived from glycerol and three fatty acids, which are medium-chain length monocarboxylic fatty acids. According to part 170 of the Code of Federal Regulations (CFR), the U.S. Food and Drug Administration (FDA) has granted triglycerides of fatty acids as GRAS (Generally Recognized As Safe) status for use as a food ingredient. The applications include food and in production of pharmaceuticals.

Diglycerides (diacylglycerols or DAGs) consist of two fatty acid chains bonded to a glycerol molecule by ester linkages. They are typically found as 1,2-diglycerides or 1,2-diacyglcerols and 1,3-diglycerides or 1,3-diacylglcerols. Commonly, used as food additives.

The subject matter includes embodiments that include further processing the once refined corn oil product 116. The process 100 may send the once refined corn oil product 116 to separate 113. Any means of separation techniques known in the art now or in the future may be used, including but not limited to centrifugation, membrane filtration, electrocoalescence, mechanical coalescence, solvent partitioning and the like. In an embodiment, membrane filtration is used where the oil stream may be cooled prior to separate 113. For example, the oil stream may be in the range of 5 to 30 degrees Celsius. The process 100 cools this oil stream, so wax and impurities 115, such as residual free fatty acid soaps and unsaponifiables, may precipitate out of the mixture. Separation techniques such as centrifugation, membrane filtration, and others then allow separation of these impurities from the oil stream. Use of membrane filtration may also have the added benefit of bleaching the oil.

Next, the process 100 sends the once refined corn oil product 116 from separate 113 to bleaching 117. Although the term bleaching refers to 'removal of color', bleaching 117 is a process used to remove impurities such as phospholipids, color bodies, decomposition products and trace metals that can be detrimental to the final quality and stability of the oil. This bleaching 117 may be performed with an adsorbent, which may be activated clay material. The activated clay material may be used in combination or in conjunction with silica gel, diatomaceous earth, activated charcoal, and the like. With bleaching, the impurities are adsorbed onto the surface of the clay. Depending on the type of impurities, the surface characteristics of the clay can be modified to suit the application.

In an embodiment, the once refined corn oil product 116 is first heated to about 80 to about 130 C under vacuum. The process 100 adds a pre-determined amount of clay material to the once refined corn oil product 116 and agitates the mixture for 15-45 minutes. In addition to the dosage of the clay, other parameters such as degree of mixing, oil temperature and residence time are critical in this process. The parameters are optimized based on the type and quality of oil that is being bleached and the final specifications that need to be met.

The process 100 using the once refined corn oil product 116 with acid activated clays showed better performance over neutral clays. The acid activated clays include, but are not limited to, Oil Dri's Perform 6000, Select Natural or Sudchemie's Tonsil 1206FF or 1212FF. However, due to the high red color and presence of phosphorus and other trace impurities, the amount of clay to use for bleaching, may be greater than normal, about 1-3% greater. The parameters for bleaching 117 include temperatures ranging from about 100 to about 120 C with about 25 to 50 minutes of contact time. This creates bleached oil 119.

Next, the process 100 sends the bleached oil 119 from bleaching 117 to deodorization 121. Deodorization 121 is a final process to ensure a bland and odor free product prior to packaging. In an embodiment, deodorization 121 uses temperatures ranging from about 220 to about 270 C at extreme vacuum of 3-5 mmHg absolute. Deodorization 121 has a residence time in a deodorizer that may range from 15 minutes to more than 60 minutes, based on the type and the quality of the oil that is being deodorized. Since the bleached oil 119 is processed to high temperatures, it is very important to optimize the residence time in the deodorizer to meet the final specifications of the final oil product. While longer residence time causes unnecessary thermal degradation of oils, lower deodorization time will not completely remove the volatile odor causing compounds causing further oxidation and degradation of the final oil post packaging.

Another important objective of deodorization 121 is to 'heat bleach' the final oil product, which is a result of degradation of color pigments such as carotenoids, lutein, zeaxanthin, and the like at high temperatures. Deodorization 121 also extracts residual free fatty acids, sterols, tocopherols and some triglycerides. In an embodiment, deodorization 121 starts with the bleached oil 119, a deodorization temperature ranging from about 240° C. to about 260° C. at less than 5 mm Hg vacuum and about 25 to about 45 minutes residence time in the deodorizer to meet the final product specifications.

Deodorization 121 produces the food grade corn oil 123 and the distillate oil 125. Deodorization 121 may be a steam stripping process in which good quality steam is injected into the bleached oil 119 under strong vacuum and high temperatures to vaporize undesirable volatile and odoriferous compounds. These compounds may make up distillate oil 125, which may include, but are not limited to, ethyl esters, free fatty acids, triglycerides, sterols, tocopherols, and the like. Tocopherols may be used as food additives, in amounts less than 1 mg/g.

The specifications for the food grade corn oil product are shown in Table 2.

TABLE 2

Specifications for Food Grade Corn Oil Product

| Analysis | Food Grade Corn Oil Product |
|---|---|
| FFA (%) | <0.05 |
| Color | >3.0-3.5R |
| Acid Value | <0.1 |
| IV | 120-130 |
| Phosphorous, PPM | <5 |
| Clarity | Clear |

TABLE 2-continued

Specifications for Food Grade Corn Oil Product

| Analysis | Food Grade Corn Oil Product |
|---|---|
| Moisture and Volatiles, % wt | <0.05 |
| Linolenic Acid, % wt | <1.5 |
| Unsaponifiable, % wt | <2 |
| Cold Test, hr | >20 |
| PV, meq/kg | <0.5 |
| OSI, hr | >8 |
| Flavor | Bland |
| TransFat, % wt | <1.0 |
| p__AV | <6 |
| Triglycerides, % wt | >94 |
| Diglycerides, % wt | <6 |

The values in Table 2. represent conditions that are acceptable to the end user of the food grade corn oil product for various applications. Most of the specifications were described in reference to Table 1. Cold test refers to the sample being refrigerated at a specific temperature for a specific amount of time to determine if it becomes haze and clouds. The time may be 20 hours. Flavor refers to the human taste profile associated with the oil through the use of taste testing studies. Para-anisidine value is a secondary oxidation measurement to determine how fast rancidity shows up. Anisidine value test is used to assess the secondary oxidation of oil or fat, which is mainly imputable to aldehydes and ketones, and is therefore able to tell the oxidation "history" of an oil or a fat.

Alternatively, the low tree fatty acid oily phase 106 may be washed with the alcohol solvent to remove residual soaps, as shown by block 108. Although water may be effective, its use alone tends to create emulsions. However, the addition of alcohol to the water to create an aqueous alcohol for washing the oil phase reduces or eliminates the emulsion than can be formed when the oil phase is mixed with water alone. As discussed above, the alcohol effects clean separation of the oil from free fatty acid soaps. For example, the same solvent that is used in the initial treatment step, such as aqueous ethanol with about 40-60% ethanol, may be used to wash the oil phase. The residual free fatty acid soaps recovered from the oil phase may be added to the alcohol phase 118 for further processing with same. The washed oil may then be processed, such as by drying 114 to remove the solvent, to recover the valuable once refined corn oil product 116. The once refined corn oil product 116 may be used for animal feed, industrial purposes including but not limited to lubricants, biodiesel, polymers, and paints, and potentially food.

As shown by block 120 of FIG. 1, the alcohol phase from the first step is treated with acid to form a lipid alcohol phase 122 and an aqueous alcohol phase 124. In the preferred embodiment, the acid is added until the pH of the mixture is 6 or below, preferably about 2. Suitable acids include both organic and inorganic acids. For example, sulfuric acid, hydrochloric acid, phosphoric acid, citric acid, oxalic acid, acetic acid, and carbonic acid may be used. As discussed above, carbonic acid may be obtained from carbon dioxide, which is produced as a byproduct of ethanol production. As much as seventeen pounds of carbon dioxide is produced per bushel of corn processed at an ethanol plant. Accordingly, carbon dioxide is an inexpensive or free, readily available substance at ethanol production plants. Some ethanol plants release this carbon dioxide into the atmosphere, while others capture it for sale. As carbon dioxide is a greenhouse gas, using the carbon dioxide in the method such that the release of carbon dioxide into the air is eliminated or reduced helps reduce greenhouse gas emissions and is, accordingly, and an environmentally friendly process. Moreover, carbon dioxide in the presence of water acts as carbonic acid. This acid will convert, or acidulate, free fatty acid soaps to free fatty acids and corresponding carbonate salts. When the preferred aqueous ethanol described above is used, water is already present in the alcohol phase 118 for reacting with carbon dioxide to create acid. It is anticipated that other substances could be added at this time as desired. Carbon dioxide acidulation provides the benefit of reducing or eliminating the use of strong acids, such as sulfuric acid, which may otherwise be necessary for acidulation of the free fatty acid soaps.

This treat with acid 120 of the process 100 may also be exploited in many different fashions, including but not limited to a batch system, a continuous stirred-tank reactor (CSTR), and continuous flow in a tubular or pipe system. In embodiments employing carbon dioxide, the treatment step with same is preferably carried out in a high pressure reactor, although it is anticipated that other systems may be used. Beneficial to the process, a high pressure reactor is air tight, which prevents the gaseous carbon dioxide from escaping. In one embodiment, carbon dioxide is collected as it is released in the ethanol production process and bubbled to the alcohol phase. After the carbon dioxide treatment step, the resulting lipid alcohol phase and aqueous alcohol phase may be collected in a decanter, where the phases are allowed to settle for 15-30 minutes before being separately drawn off. Alternatively, the separation of the phases may be effected by a liquid-liquid centrifuge or other means known in the art now or in the future, but due to the pH of the output, it is often desirable to use other means to separate the two phases. For example, the low pH of the output may corrode some centrifuges. The aqueous alcohol phase 124 generally includes ethanol, water, and salts. The lipid alcohol phase 122 primarily includes ethanol, free fatty acids, and water.

The lipid alcohol phase may be processed to recover the free fatty acids contained therein. In the preferred embodiment, the lipid alcohol phase 122 is dried, as shown by block 126. Processes such as evaporation or distillation may be used to recover the free fatty acids. Accordingly, the process results in free fatty acids 130. It is anticipated that the disclosed process 100 will result in high recovery of free fatty acid with low neutral oil loss. In some embodiments, neutral oil loss may be 2% or lower. Once the alcohol present in the lipid alcohol phase 122 has been separated from the free fatty acids 130, it may be reused if desired, but may require dilution with water to obtain the appropriate concentration. In addition, the aqueous alcohol phase 124 may be recycled to the beginning of the process, as shown in block 128.

The specifications for free fatty acid product are shown in Table 3.

TABLE 3

Specifications for Free Fatty Acid Product

| Analysis | Free Fatty Acid Product |
|---|---|
| FFA (%) | >50 |
| Acid Value | >100 |
| IV | 105-115 |
| Moisture and Volatiles, % wt | <1 |
| Unsaponifiable, % wt | <4 |
| PV, meq/kg | <2 |

TABLE 3-continued

Specifications for Free Fatty Acid Product

| Analysis | Free Fatty Acid Product |
|---|---|
| OSI, hr | >5 |
| Triglycerides, % wt | <35 |

The values in Table 3. represent conditions that are acceptable to the end user of the free fatty acid product for various applications. Most of the specifications were described in reference to Tables 1. and 2.

Figure 2:
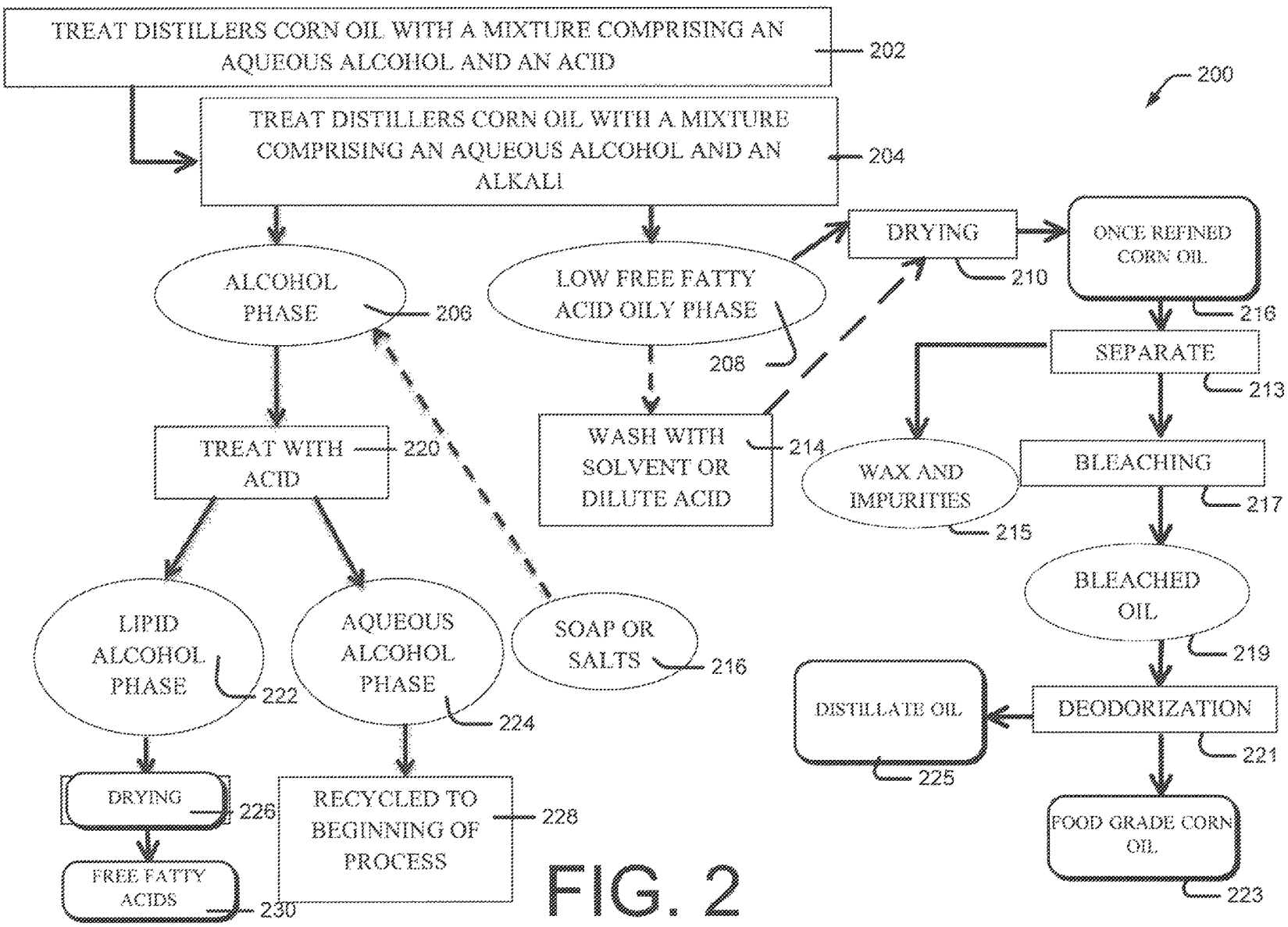
FIG. 2 is a flow chart according to one or more examples of a second embodiment of a method to recover free fatty acids from fats and oils and to produce refined oil products and a free fatty acid product, wherein the fats and oils are first treated with an alcohol and an acid to remove impurities in the distillers corn oil.

Referring to FIG. 2, a second embodiment of a process 200 to recover free fatty acids from fats and oils is provided. The embodiment begins by treating distillers corn oil with a mixture comprising an aqueous alcohol and an acid, as shown in block 202. This embodiment is advantageous for waste fats and oils that originate from oils that contain impurities such as phospholipids. The aqueous alcohol and acid effectively hydrates all the phospholipids and separates them from the fats and oils. If fats and oils containing phospholipids are not processed to an acid treatment process, they would interfere with the free fatty acid extraction process and thus increase the neutral oil loss. Specifically, the presence of phospholipids results in an emulsion layer that entraps neutral oil. In the current process, the addition of alcohol reduces or eliminates the need to remove the phospholipids from the resulting mixture or phase containing same prior to proceeding with the process. Rather, the phospholipids are solubilized in an alcohol phase, resulting in better separation from the other valuable products.

As provided in block 204 of FIG. 2, a mixture comprising an aqueous alcohol and alkali is then added to the mixture resulting from step 202. In some embodiments, it may not be necessary to add further alcohol, and only an alkali will be added at this step. As discussed above, the alkali converts the free fatty acids present in the distillers corn oil into free fatty acid soaps. The alcohol, which is preferably an aqueous alcohol, helps to effect clean separation of an alcohol phase 206 and low-free fatty acid oily phase 208.

The remaining steps of the second embodiment of a process 200 to recover free fatty acids from fats and oils are similar to that of the first-described embodiment of a process of the present disclosure. Namely, the low free fatty acid oily phase 208 may be washed with acid or solvent, as shown in block 214 to produce salts or soap 216, respectively, and the once refined corn oil product 216. The washed, low free fatty acid oil phase 208 may be dried 210 to produce valuable the once refined corn oil product 216. In addition, as shown by block 210 of FIG. 2, the low free fatty acid oily phase 208 may be dried to produce once refined oil corn product 216 without undergoing a wash step. The process 200 may send the once refined corn oil product 216 to separate 213, to bleaching 217, to create a bleached oil product 219, to deodorization 221 to produce a food grade corn oil product 223 and a distillate oil product 225. These processes were described in detail with reference to FIG. 1.

The alcohol phase 206 may be treated with acid 220 to produce a lipid alcohol phase and an aqueous alcohol phase 224. The lipid alcohol phase 222 may be processed, such as by drying 226, to produce recovered free fatty acids 230. The aqueous alcohol phase 224 may be recycled to the beginning of the process, as shown in block 228.

Figure 3:
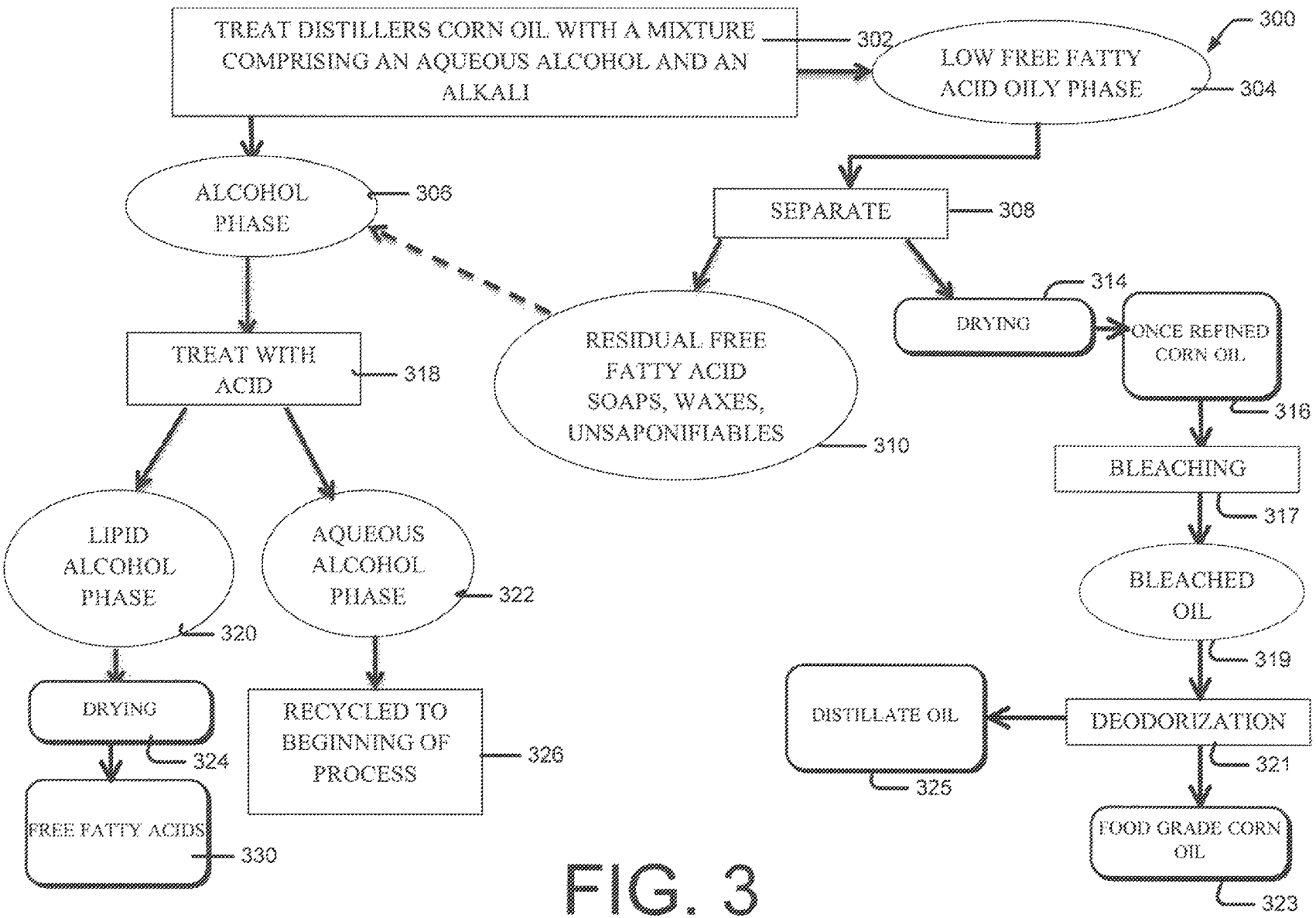
FIG. 3 is a flow chart according to one or more examples of a third embodiment of a method to recover free fatty acids from fats and oils, and to produce refined oil products and a free fatty acid product, wherein low free fatty acid oil is separated to remove residual fatty acid soaps, waxes, and unsaponifiables.

Referring to FIG. 3, is a third embodiment of a process 300 for recovering free fatty acids from distillers corn oil, the low free fatty acid oily phase 304 may be further processed to remove waxes, unsaponifiables, and residual fatty acid soaps. The dewaxing process 300 begins by treating the distillers corn oil with a mixture comprising an aqueous alcohol and an alkali, as shown by block 302. This treatment results in an alcohol phase 306 and a low-free fatty acid oily phase 304. The low-free fatty acid oily phase 304 may be separated, as shown by block 308. Any means of separation known in the art now or in the future may be used, including but not limited to centrifugation, membrane filtration, electrocoalescence, mechanical coalescence, solvent partitioning, and the like. In embodiments including membrane filtration, the oil may be cooled prior to separation; for example, the oil may be in the range of 5 to 30 degrees Celsius. By cooling the low-free fatty acid oily phase 304, impurities such as residual free fatty acid soaps, waxes, and unsaponifiables may precipitate out of the mixture. Separation techniques such as centrifugation, membrane filtration, and others then allow separation of these impurities such as residual free fatty acid, soaps, waxes, and unsaponifiables 310 from the oil. Use of membrane filtration may also have the added benefit of bleaching the oil. The resulting low free fatty acid oil exiting a centrifuge may be dried, as shown by block 314 to produce once refined corn oil product 316. The oil may be processed as discussed above, such as with a dilute acid wash to produce dewaxed once refined corn oil product 316.

The process 300 may send the once refined corn oil product 316 to bleaching 317, to create a bleached oil product 319, to deodorization 321 to produce a food grade corn oil product 323 and a distillate oil product 325. These processes were described in detail with reference to FIG. 1.

The residual fatty acid soaps, waxes, and unsaponifiables shown in block 310 may be mixed with the alcohol phase 306 for further processing or may be processed separately. Namely, the alcohol phase 306 is treated with acid, as shown by block 318. This step 318 creates a lipid alcohol phase 320 and an aqueous alcohol phase 322. The lipid alcohol phase 320 may be processed to recover recovered free fatty acids 328, such as by drying 324. The aqueous alcohol phase 322 may be recycled to the beginning of the process, as shown by block 326.

It will be appreciated by one skilled in the art that a number of other processing steps known in the art, either now or in the future, may be employed in a process of the present disclosure. In one example, a bleaching agent may be used. Waste fats and oils are generally dark in color due to the presence of impurities. Previous processes to bleach these fats and oils have included the use of bleaching clays. In processes of the present disclosure, fats and oils may be treated with a mixture comprising an alcohol, alkali, and bleaching agent. A liquid or dissolved bleaching agent is preferred. The bleaching agent will remove color from the resulting oil. Similar to the above-described processes, this treatment results in an alcohol phase and a low free fatty acid oily phase. The phases may be processed as discussed above to produce oil, recovered free fatty acids, and aqueous alcohol that may be recycled to treat further fats and oils. Suitable bleaching agents include, but are not limited to, hypochlorite, peroxide, chlorite, and peroxyacid. Namely, sodium hypochlorite, benzoyl peroxide, hydrogen peroxide, per-acetic acid, sodium percarbonate, sodium perborate, and sodium borohydride maybe used.

Figure 4:
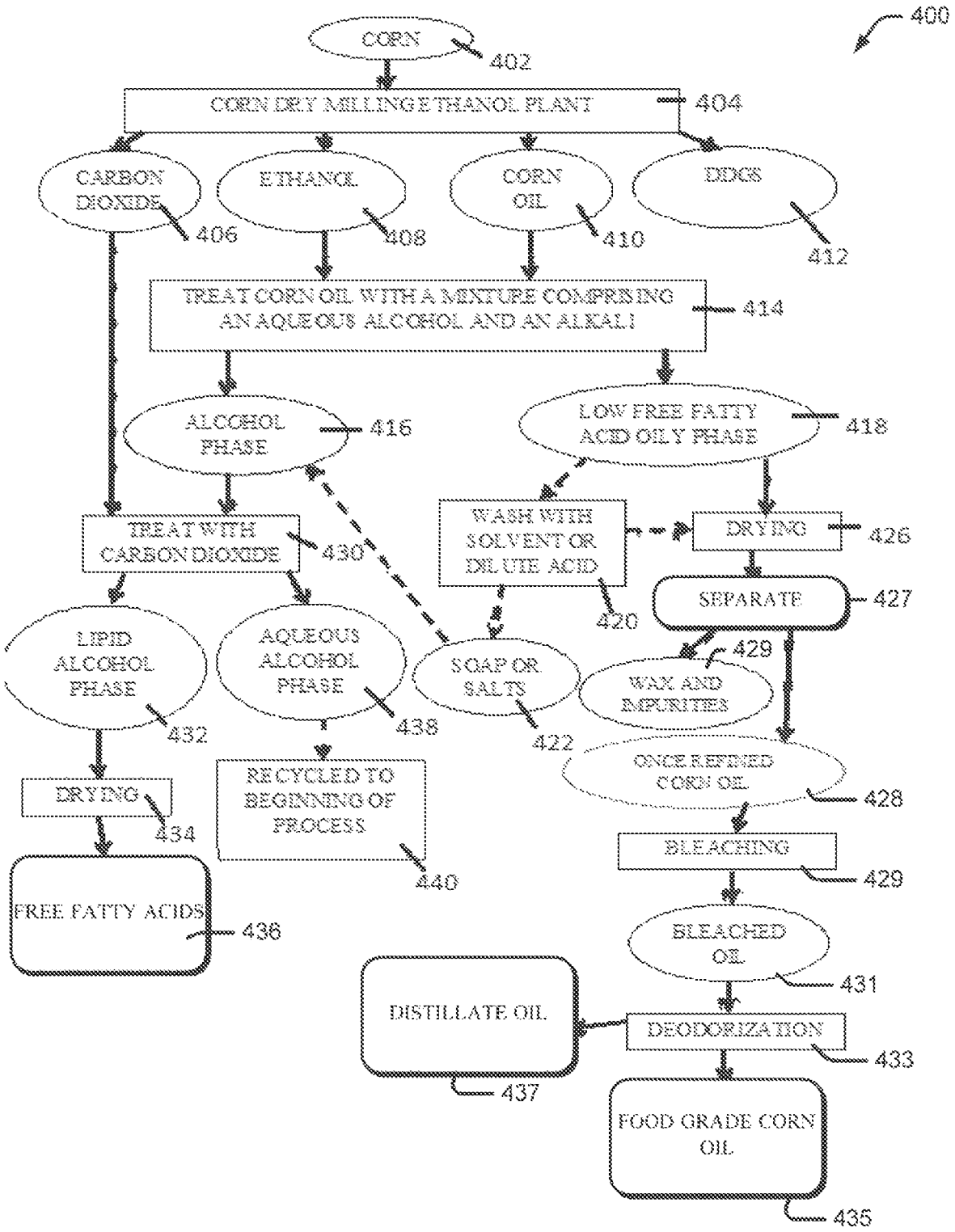
FIG. 4 is a flow chart according to one or more examples of a fourth embodiment of a method to recover free fatty acids from distillers corn oil, which produces refined corn oil products and a free fatty acid product, wherein the method takes place at an ethanol production facility.

Referring to FIG. 4, a fourth embodiment of a process 400 to recover free fatty acids from fats and oils begins with corn 402 at a corn dry milling, ethanol plant 404. The corn dry milling ethanol plant 404 process produces at least four products: carbon dioxide 406, ethanol 408, corn oil 410, and dried distillers grains with solubles (DDGS) 412. As discussed above, the process 400 of the present disclosure may be used to recover free fatty acids from fats and/or oils with high free fatty acid content, and in particular the illustrated corn oil 410. As shown in block 414, the corn oil 410 is treated with a mixture comprising the aqueous ethanol and an alkali. Suitable alkalis are as discussed above. This treatment results in an alcohol phase 416 and a low-free fatty acid oily phase 418. The low free fatty acid oily phase 418 may be treated to recover valuable once refined corn oil product 428. For example, the low-free fatty acid oily phase 418 may be washed with solvent or dilute acid, as shown in block 420. The wash may produce soap or salts 422, respectively. Optionally, the soap or salts may be added to the alcohol phase 416.

In other embodiments, the low-free fatty acid oily phase 418 may instead be dried 426 immediately to produce valuable once refined corn oil product 428. It is anticipated that in many embodiments, the low-free fatty acid oily phase 418 will be of a high enough quality that only drying 426 is necessary to produce a saleable product.

However, in an embodiment, the process 400 sends the oil stream from drying 426 to Separate 427. Any means of separation known in the art now or in the future may be used, including but not limited to centrifugation, membrane filtration, electrocoalescence, mechanical coalescence, solvent partitioning and the like. In embodiments including membrane filtration, the oil stream may be cooled prior to separation; for example, the oil stream may be in the range of 5 to 30 degrees Celsius. By cooling the low-free fatty acid oily phase 418, wax and impurities 429 such as residual free fatty acid soaps, and unsaponifiables, may precipitate out of the mixture. Separation techniques such as centrifugation, membrane filtration, and others then allow separation of these impurities from the oil stream. Use of membrane filtration may also have the added benefit of bleaching the oil.

Turning to drying 426, the process 400 sends the stream to separate 427, to produce the once refined corn oil product 428. This is product that may be sold. The process 400 may further send the once refined corn oil product 428 to bleaching 429, to create a bleached oil product 431, to deodorization 433 to produce a food grade corn oil product 435 and a distillate oil product 437. These processes were described in detail with reference to FIG. 1.

The alcohol phase 416 may be further processed to recover free fatty acids. Specifically, as shown in block 430 the alcohol phase may be treated with carbon dioxide 406 produced by the ethanol plant 404. As discussed above, carbon dioxide dissolves in water to form carbonic acid, thus serving to acidulate the free fatty acid soaps. It is anticipated that in many embodiments, other organic or inorganic acids will be used. This treatment with acid 430 results in a lipid alcohol, phase 432 and an aqueous alcohol phase 438. The lipid alcohol phase 432 may be processed, such as by drying 434 to produce recovered free fatty acids 436. The aqueous alcohol phase 438 may be recycled to treat further corn oil, as shown by block 440.

In some embodiments, feedstocks from ethanol plants include unique components. These unique components are often the result of reactions at the ethanol plant. For example, some corn oil feedstocks include ethyl esters of fatty acids. The ethyl esters often remain with the oily phase. However, it is possible to direct the ethyl esters into the alcohol phase after the corn oil is treated with alcohol. In such a case, the ethyl esters may generate ethanol. Specifically, the ethyl esters can be mixed with caustic to saponify the ethyl esters to form fatty acid soap. This soap when treated with an acid as described in the above embodiment will generate fatty acids and ethanol. In this embodiment, the process results in net increase in ethanol. Accordingly, in this embodiment, the ethanol may not be limited to a solvent, but can also be a product of the process.

EXAMPLES

Example 1

This example illustrates the use of a batch reactor to extract free fatty acids from distillers corn oil (DCO) containing 13.2% free fatty acids. A test reaction was performed where 207.8 grams of DCO was added to a 500 ml flask. The corn oil may also be referred to as feedstock. The temperature of the corn oil was raised from ambient temperature to 65 degrees Celsius. A solvent phase was then prepared for use in the reaction. The solvent phase was prepared by initially creating a solution of aqueous ethanol, containing 40% ethanol by weight. Thereafter, 3.9 grams of sodium hydroxide was added to 127.6 grams of aqueous ethanol. In a separate flask, the solvent phase and alkali were mixed and heated from ambient temperature to 65 degrees Celsius. The alkaline solvent was added to the feedstock and the mixture was then agitated for one minute, after which, the mixture was allowed to separate, in a 65 degree Celsius environment, into two distinct phases. The top phase was collected and dried to yield 179.8 grams of oil with free fatty acid content of 0.2%. 114.6 grams of the bottom solvent phase were collected into a separate beaker to which concentrated Sulfuric acid was added until the pH of the mixture was 2. The mixture was then agitated for one minute, after which, it was allowed to separate, in a 65 degree Celsius environment, into two distinct phases. The top phase was separated and dried to yield 27.3 grams of fatty acids. Experimental losses of oil to glassware and other equipment amounted to 4 grams. Yield of free fatty acids may be calculated by measuring the amount of free fatty acids that are recovered as compared to the free fatty acids that are present in the fired stock. Yield of free fatty acids in this example is 98.6%. The neutral oil loss is calculated by measuring the weight of neutral oil in the feedstock minus the weight of neutral oil in the low free fatty acid oil. This example resulted in a 2.1% calculated neutral oil loss.

Example 2

This example illustrates extraction of free fatty acids from used cooking oil (UCO) containing 11.4% free fatty acids using a batch reactor. A test reaction was performed where 202.8 grams of UCO was added to a 500 ml flask and heated to 65 degrees Celsius. The solvent phase was prepared by initially creating a solution of aqueous ethanol, containing 55% ethanol by weight. Thereafter, 3.3 grams of sodium hydroxide were added to 122.6 grams of aqueous ethanol in a separate flask and heated to 65 degrees Celsius. The alkaline solvent was added to the feedstock, and the mixture was then agitated for one minute, after which, the mixture was allowed to separate into two distinct phases. The top phase was collected and dried to yield 175.9 grams of oil with free fatty acid content of 0.2%. 107.6 grams of the bottom solvent phase were collected into a separate beaker to which concentrated sulfuric acid was added until the pH of the mixture was 2. The mixture was then agitated for one minute, after which, it was allowed to separate, in a 65 degree Celsius environment, into two distinct phases. The top phase was separated and dried to yield 25 grams of fatty acids. Experimental losses of oil to glassware and other equipment amounted to 1.4 grams. Yield of free fatty acids in this example is 92%. The neutral oil loss in this example is 1.9%.

Example 3

This example illustrates extraction of free fatty acids from feed grade crude tallow containing 15.8% free fatty acids using, a batch reactor. A test reaction was performed where 203.8 grams of UCO were added to a 500 ml flask and heated to 65 degrees Celsius. The solvent phase was prepared by initially creating a solution of aqueous ethanol, containing 40% ethanol by weight. Thereafter, 4.7 grams of sodium hydroxide were added to 125.6 grams of aqueous ethanol in a separate flask and heated to 65 degrees Celsius. The alkaline solvent was added to the feedstock, and the mixture was then agitated for one minute, after which, the mixture was allowed to separate into two distinct phases. The top phase was collected and dried to yield 159.9 grams of tallow oil with free fatty acid content of 0.2%. 120.8 grams of the bottom solvent phase were collected into a separate beaker to which concentrated sulfuric acid was added until the pH of the mixture was 2. The mixture was then agitated for one minute, after which, it was allowed to separate, in a 65 degree Celsius environment, into two distinct phases. The top phase was separated and dried to yield 42.5 grams of fatty acids. Experimental, losses of oil to glassware and other equipment amounted to 5.4 grams. Yield of free fatty acids in this example is 96%. The neutral oil loss in this example is 6.6%.

Example 4

This example illustrates extraction of free fatty acids from distillers corn oil that is being produced at a commercial corn dry milling ethanol production facility. Distillers corn oil is continuously produced at a rate of 3 gal/min with an average of 15.5 wt % free fatty acids at the ethanol production facility. The corn oil is heated to 65° C. and is passed through a tubular reactor where it is mixed with 1.8 gal/min of 40 wt % ethanol solution that is premixed with 0.3 gal/min of 50 wt % sodium hydroxide. After mixing, the reaction mixture is allowed to mechanically separate into two phases. The top phase of low free fatty acid corn oil is pumped out at a rate of 2.6 gal/min, and the bottom solvent phase is pumped into another tubular reactor where it is mixed with concentrated sulfuric acid until the pH of the mixture is 2. The reaction mixture is further separated into two phases. The top free fatty acid phase is recovered and further dried to remove residual solvent to produce 0.5 gal/min of free fatty acids. Yield of free fatty acids in this example is 96%. The neutral oil loss in this example is 1.4%.

Example 5

Several experiments were conducted in order to determine the effect of alcohol proof. With the exception of the ethanol concentration in the solvent, the experimental procedure followed was similar to that described in the above examples. Ethanol concentrations from 5 wt % up to 100 wt % (absolute alcohol) were tested to determine the impact on reaction, separation, neutral oil loss, and free fatty acid yield. In general, different ethanol proofs did not have an impact on the reaction. However, with respect to the separation, when using gravity, ethanol solutions between 15 wt % and 55 wt % resulted in the lowest neutral oil loss alone with high yield of free fatty acids. A middle emulsion layer was formed when ethanol solutions below 15 wt % were used. This resulted in higher oil loss due to the entrainment of the oil in the emulsion layer. Using a centrifugal separator, in place of gravity, may eliminate the possibility of forming a middle emulsion layer. Ethanol solutions between 60 wt % and 70 wt % caused convolution of oily phase and alcohol phase due to similar densities. As a result, efficient separation of two phases becomes impossible. Ethanol solutions above 70 wt % resulted in efficient phase separation but resulted in high neutral oil loss due to higher solubility of oil in alcohol phase.

Example 6

Experiments were conducted in order to determine the role of temperature on the reaction, separation, neutral oil loss, and free fatty acid yield. With the exception of the target temperature, the experimental procedure followed was similar to that described in the above examples. The neutralization reaction and the acidulation have been performed between 25° C. and 75° C. at atmospheric pressure. Results indicated that the temperature had minimal impact on the completion of the reaction. However, it was observed that temperature above 50° C. resulted in a quicker and cleaner separation of the two phases resulting in minimal oil loss to the alcohol phase.

Example 7

With intent to use less amount of solvent, several experiments were conducted in order to determine the effect of solvent to oil ratio on reaction, separation, neutral oil loss and free fatty acid yield. With the exception of the amount of solvent used, the experimental procedure followed was similar to that described in the above examples. Solvent to oil ratios from 0.2 up to 0.6 were tested. Test results indicated that solvent to oil ratios below 0.4 impacted reaction, separation, and neutral oil loss. Specifically, solvent ratio of below 0.4 failed to completely extract the free fatty acids from the oil due to incomplete reaction. This could be a result of not enough mixing between solvent and oil phases. This problem can be overcome by using high shear mixers. However, the use of high shear mixers can result in stable emulsions between oil and solvent phases increasing the high neutral oil loss. At solvent ratios below 0.2, in addition to incomplete reaction and fatty acid extraction, a middle emulsion layer was formed which resulted in higher oil loss due to the entrainment of the oil in the emulsion layer. At this ratio there may not be enough ethanol to assist in effective separation of two phases. Using a centrifugal separator, in place of gravity, may eliminate the possibility of forming a middle emulsion layer.

Example 8

This example illustrates the use of a filtration process to remove waxes, soaps and other impurities. Low free fatty acid corn oil from Example 4 is dried to remove moisture and any residual solvent. This oil was tested to comprise of 0.60 w % of wax and 400 ppm of fatty acid soaps. This oil is slowly cooled to a temperature of 40° F., followed by being slowly reheated to a temperature of 75° F. This oil is then passed through a microporous filter. The microporous filtration generates both a permeate and a retentate. Permeate from the filtration process is very clear and brilliant. After the permeate sample is soaked in an ice bath at 32° F. for twenty four hours the sample has no visual signs of wax content crystallization. Filtration permeate was tested to have 29 ppm of wax and the presence of fatty acid soaps was undetectable.

Example 9

Laboratory experiments were performed to represent bleaching and deodorizing. In an experiment to represent bleaching, a sample of approximately 100 g of once refined corn oil was heated to about 60° C. in a beaker and then slurried with 1% by weight Perform 6000 clay from Oil-Dri. The slurry was then heated to and maintained at 110° C. under vacuum 25"Hg for 30 minutes and then filtered through a sheet of Whatman grade 4 filter paper under 40 psi N2 in a baroid filter press. As a result, approximately 94.5 g of bleached oil was obtained.

Next, the experiment represented deodorizing. The bleached oil sample was then deodorized in a laboratory scale deodorizer under 30" Hg vacuum for 34 minutes around 255° C. The deodorized oil was cooled down to 100° C. when steam was completely shut off and further cooled down to 60° C. At this temperature, the samples were transferred to storage containers. 89.8 g of deodorized oil was obtained with free fatty acid content of 0.05% by weight.

Additional laboratory experiments were performed with the data shown in Table 4.

TABLE 4

Bleaching and Deodorizing

| Analysis | Once Refined Corn Oil | Bleached Sample | Deodorized Sample |
|---|---|---|---|
| FFA (%) | 0.16 | | .05 |
| Moisture (%) | 0.10 | | 0.07 |
| Trans Fat (%) | 0 | | 0.12 |
| Color | 68R | 30R | 2.5R |

The data indicate the bleached sample reduced the color significantly from the once refined oil at 68R to 30R, which is further reduced to 2.5R after deodorization.

Example 10

There were several laboratory trials conducted to determine the percent of free fatty acid content in the materials based on refining versus bleaching and deodorization. The starting samples were of once refined corn oil.

TABLE 5

Bleaching and Deodorizing

| Analysis | Once refined oil (% FFA) | Bleaching and Deodorization (% FFA) |
|---|---|---|
| Trial 1 | 0.045 | 0.03 |
| Trial 2 | 0.05 | 0.045 |
| Trial 3 | 0.09 | 0.065 |
| Trial 4 | 0.07 | 0.035 |

The trials used alkali refining based on various stoichiometry and hold times, for Trials 1, 2, 3, and 4, respectively. There were significant differences shown with Trials 3 and 4. Overall, the specifications for the food grade products were met with these trials.

Although various representative embodiments of this disclosure have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure. It is intended that all matter contained in the above description or shown in the accompanying drawings shall be interpreted as illustrative only and not limiting. Changes in compositions, detail or structure may be made without departing from the spirit of the disclosure as defined in the appended claims.

Although the present disclosure has been described with reference to the embodiments outlined above, various alternatives, modifications, variations, improvements and/or substantial equivalents, it is understood that the subject matter defined is not necessarily limited to the specific features of acts described. Rather, the specific features and acts are examples. Listing the steps of a process in a certain order does not constitute any limitation on the order of the steps of the process. Accordingly, the embodiments of the disclosure set forth above are intended to be illustrative, not limiting.

What is claimed is:

1. A refined corn oil product produced from distillers corn oil, the refined corn oil product comprising:

a free fatty acid content of less than about 1% by weight;

a moisture content ranging from about 0.09% to about 0.35% by weight; and a tocopherol content less than about 1 mg/g;

wherein the refined corn oil product has an oxidative stability value of greater than 5.

2. The product of claim 1, wherein the refined corn oil product has a peroxide value of less than 2 meq/kg.

3. The product of claim 1, wherein the refined corn oil product has a beta-carotene content greater than about 2 μg/g.

4. The product of claim 1, wherein the refined corn oil product has transfat content of less than 1% by weight.

5. A food grade corn oil product produced from distillers corn oil, the food grade corn oil product comprising:

a free fatty acid content less than 0.05% by weight percent;

a moisture content ranging from about 0.1% to about 0.5% by weight; and a tocopherol content less than about 1 mg/g;

wherein the food grade corn oil product has a peroxide value of less than 0.5 meq/kg.

6. The product of claim 5, wherein the food grade corn oil product has a color ranging from 3.1 to 3.5 R.

7. The product of claim 5, wherein the food grade corn oil product has an acid value less than 0.1% by weight.

8. The product of claim 5, wherein the food grade corn oil product has an oxidative stability value of Greater than 5.

9. The product of claim 5, wherein the food grade corn oil product has a transfat content of less than 1.0% by weight.

10. free fatty acid product produced from distillers corn oil, the free fatty acid product comprising:

a free fatty acid content of greater than 50% by weight;

a moisture content less than about 1% by weight; and a tocopherol content less than about 1 mg/g.

11. The product of claim 10, wherein the free fatty acid product has a moisture content of about 0.9% by weight.

12. The product of claim 10, wherein the free fatty acid product has a. moisture content of about 0.5% by weight.

13. The product of claim 10, wherein the free fatty acid product has an oxidative stability index greater than 5.

14. The product of claim 10, further comprising triglycerides of less than 35% by weight.

15. A food grade corn oil product produced from distillers corn oil, the food grade corn oil product comprising:

a free fatty acid content less than 0.05% by weight percent;

a moisture content ranging from about 0.1% to about 0.5% by weight; and a tocopherol content less than about 1 mg/g;

wherein the food grade corn oil product has a color ranging from 3.1 to 3.5 R.

* * * * *